United States Patent [19]

Frohbieter

[11] Patent Number: 4,458,377

[45] Date of Patent: Jul. 10, 1984

[54] WET CARPET CLEANING APPARATUS

[75] Inventor: Edwin H. Frohbieter, Lincoln Township, Berrien County, Mich.

[73] Assignee: Whirlpool Corporation, Benton Harbor, Mich.

[21] Appl. No.: 320,593

[22] Filed: Nov. 12, 1981

[51] Int. Cl.[3] ..... A47L 11/34

[52] U.S. Cl. ..... 15/320; 15/321; 15/328; 15/353; 15/405; 15/409

[58] Field of Search ..... 15/320, 321, 353, 409, 15/314

[56] References Cited

U.S. PATENT DOCUMENTS

| | | | |
|---|---|---|---|
| 1,621,596 | 3/1927 | Minuth | 15/409 X |
| 2,293,115 | 8/1942 | Child | 15/409 X |
| 3,324,499 | 6/1967 | West | 15/409 X |
| 3,705,437 | 12/1972 | Rukavina et al. | 15/314 X |
| 3,808,631 | 5/1974 | Shibata et al. | 15/409 X |
| 3,939,527 | 2/1976 | Jones | 15/321 X |
| 3,940,826 | 3/1976 | Phillips et al. | 15/320 |
| 3,974,541 | 8/1976 | Silvis et al. | 15/320 |

*Primary Examiner*—Chris K. Moore
*Attorney, Agent, or Firm*—Wood, Dalton, Phillips, Mason & Rowe

[57] ABSTRACT

A wet carpet cleaning apparatus having a nozzle movable over the surface to be cleaned. Structure is associated with the nozzle for selectively delivering cleaning liquid to a cleaning portion of the nozzle. A suction apparatus is removably mounted to the nozzle for removing liquid including dirt-laden water from the surface being cleaned. The suction apparatus comprises a removable suction fan or blower module which may be employed to advantage in a number of other applications. A jet pump is associated with the nozzle for discharging removed dirt-laden liquid as to a drain. The cleaning liquid is obtained from a pressurized water supply through an elongated flexible duct and the discharge to drain is through an elongated flexible duct which may be of similar construction. Manually controlled structure is provided for selectively introducing detergent into the cleaning liquid to permit selective cleaning and rinsing operations with the supplied pressurized water. The jet pump is operated by the pressurized water to effect the suction removal of the dirt-laden liquid from a collecting chamber in the nozzle to the drain duct. An auxiliary wand structure may be provided with a nozzle for cleaning elevated surfaces, such as furniture, steps, etc. An auxiliary scrubbing brush and an auxiliary squeegee may be mounted to the nozzle such as for cleaning hard floor surfaces.

7 Claims, 21 Drawing Figures

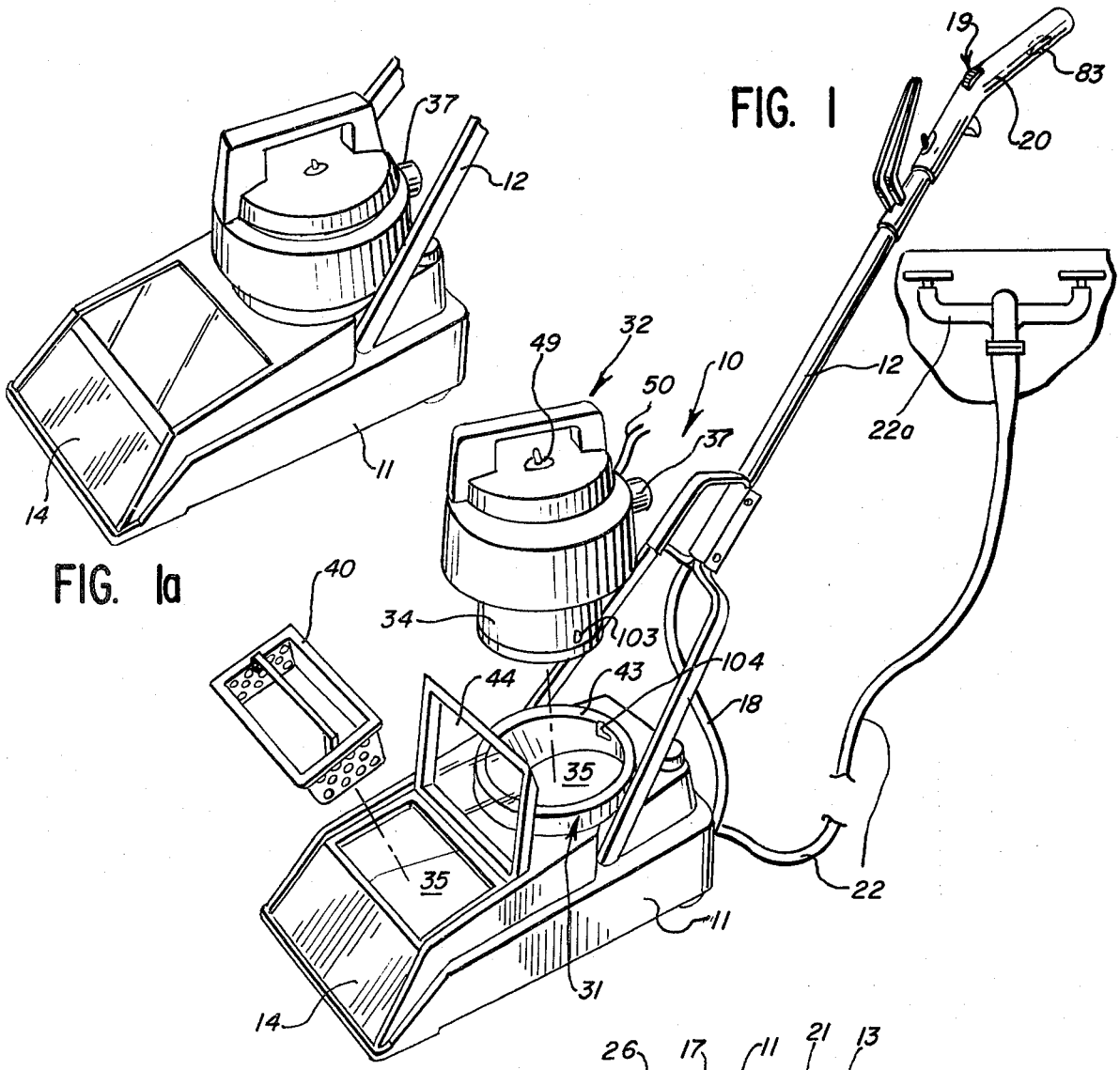
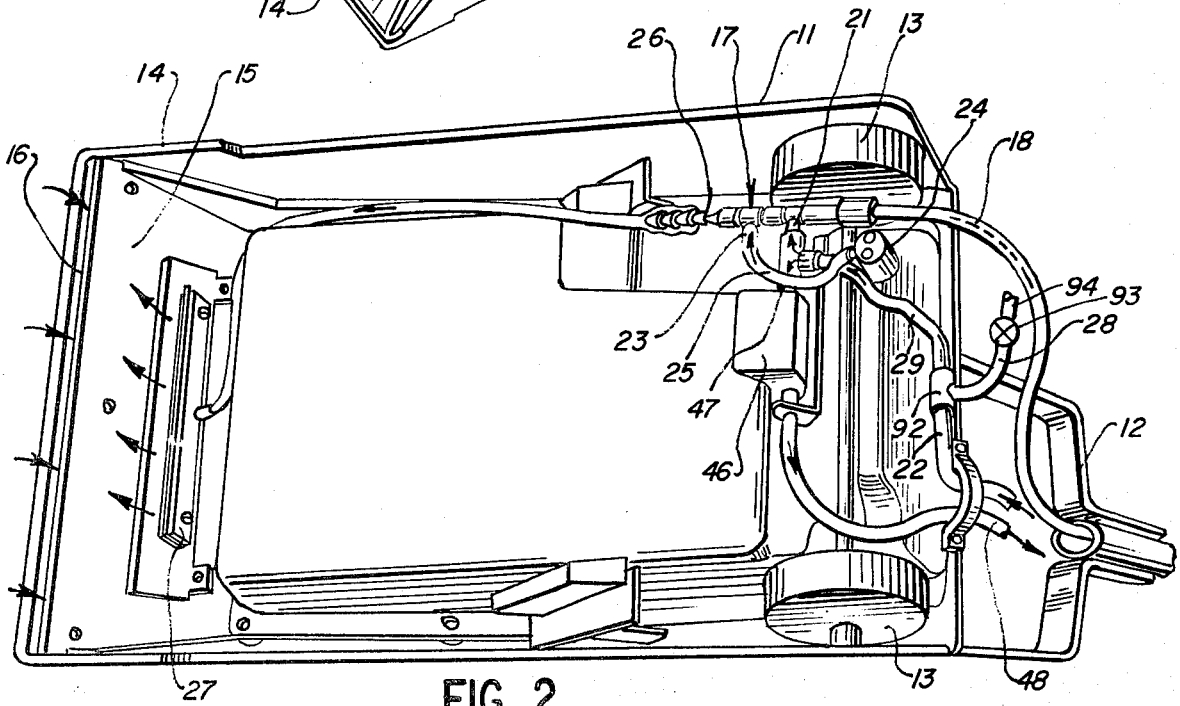
FIG. 2

11
13
14
15
16
24
25
27
31
32
33
34
35
36
37
38
39
40
41
42
43
44
45
46
49
90
91

FIG. 6a
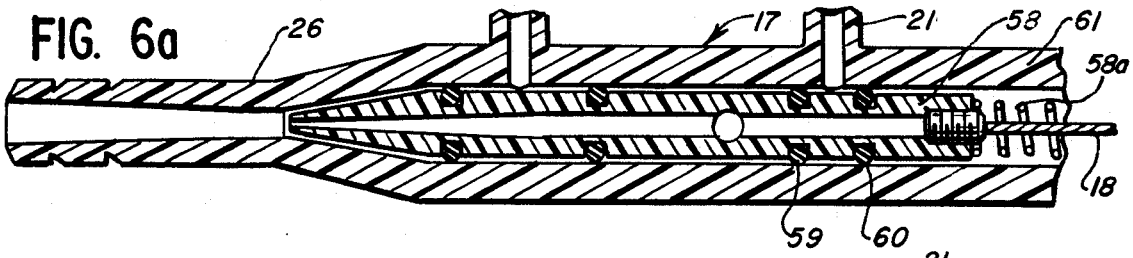
FIG. 6b
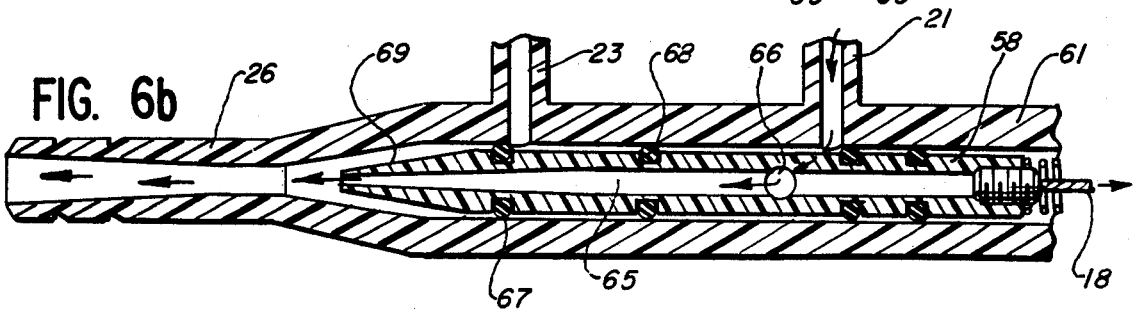
FIG. 6c
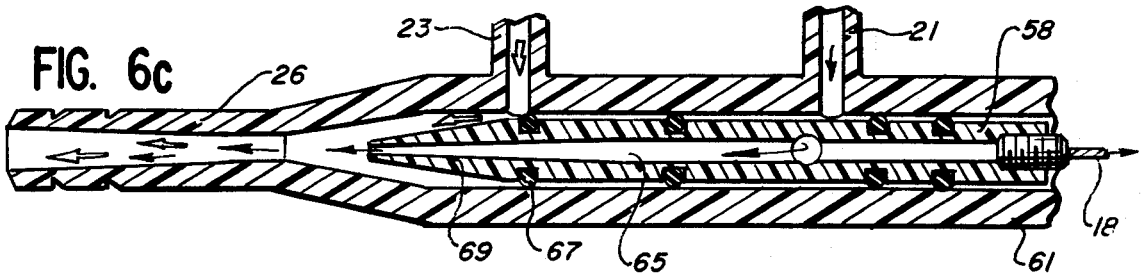
FIG. 6d
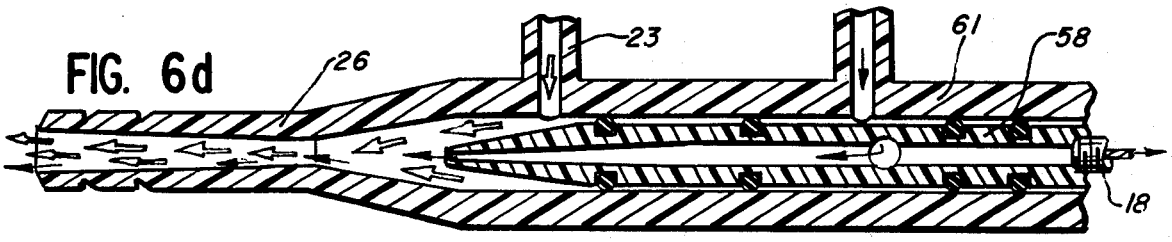
FIG. 7a
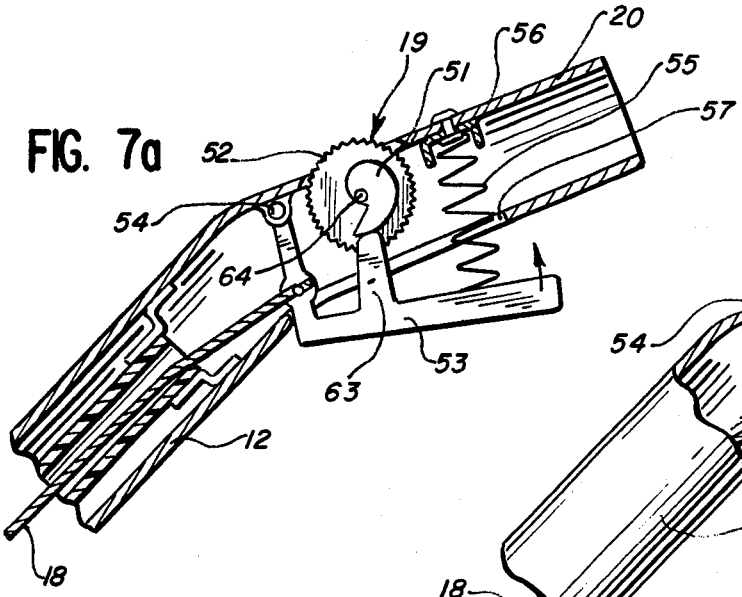
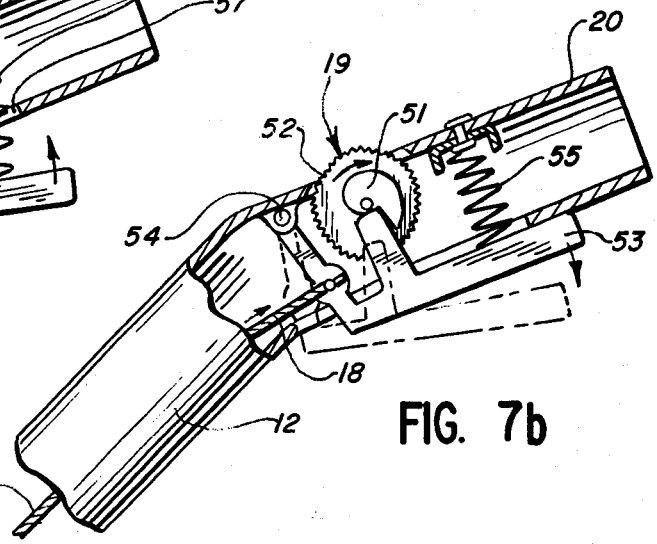
FIG. 7b FIG. 8
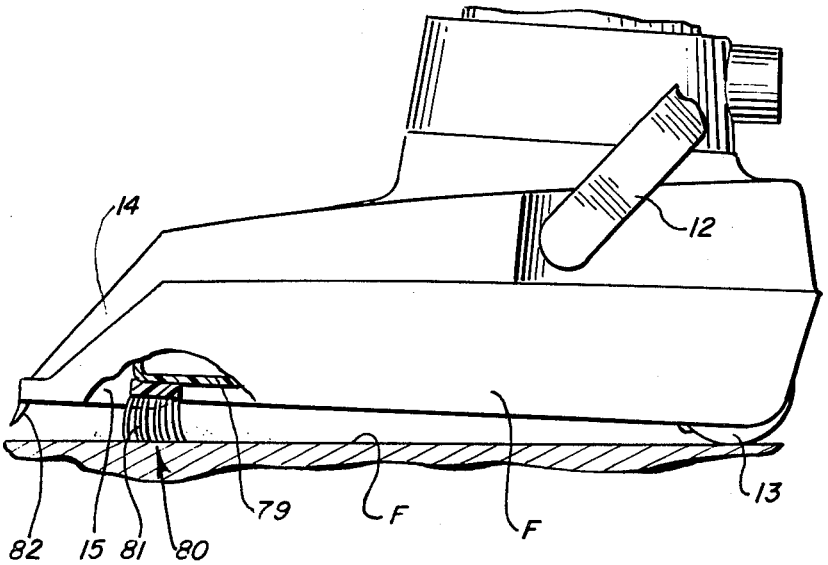
FIG. 11
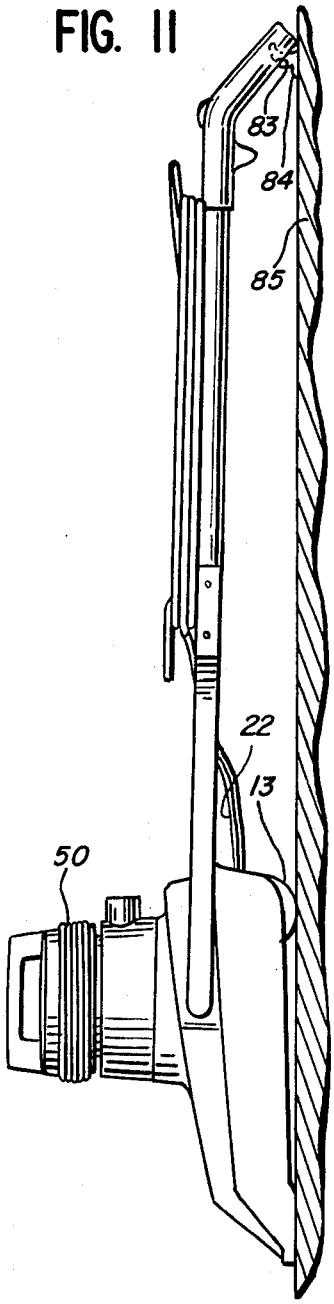
FIG. 9
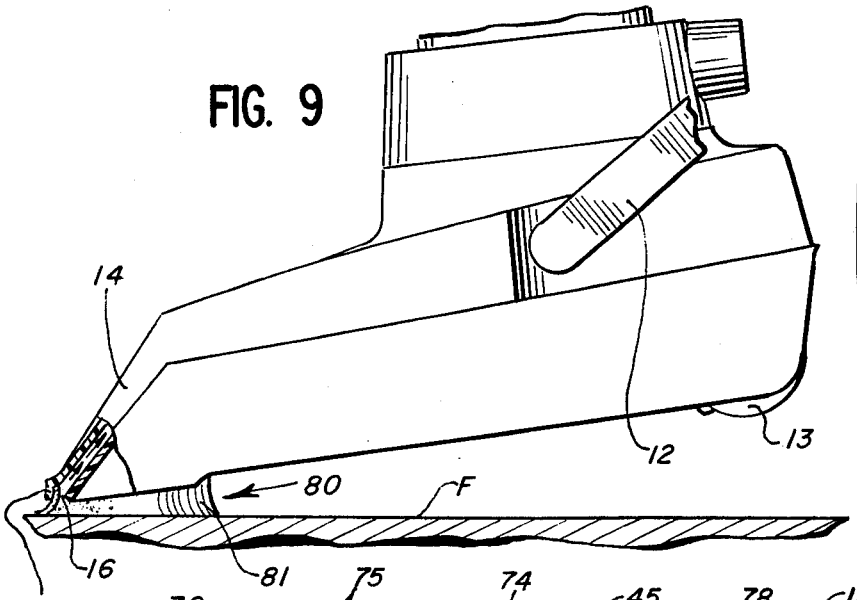
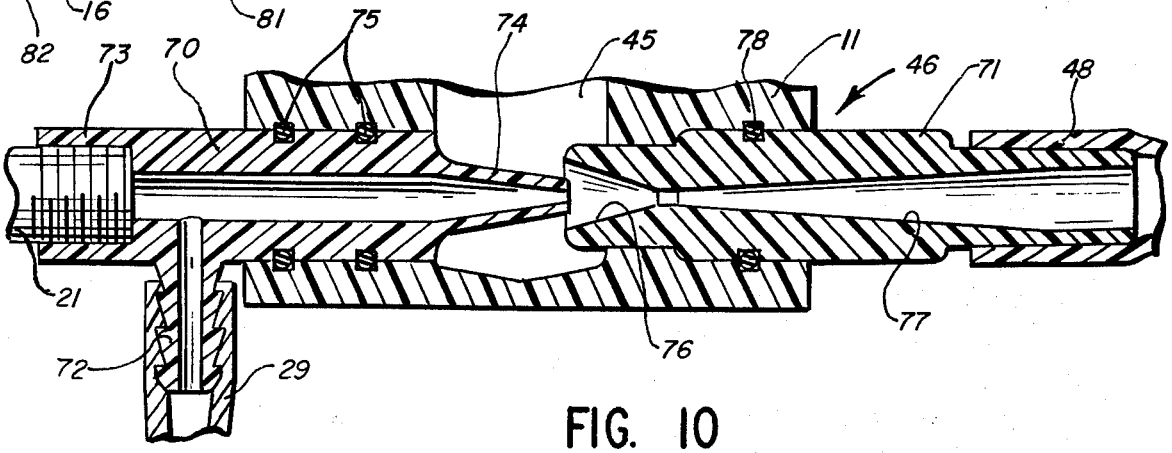
FIG. 10

FIG. 12
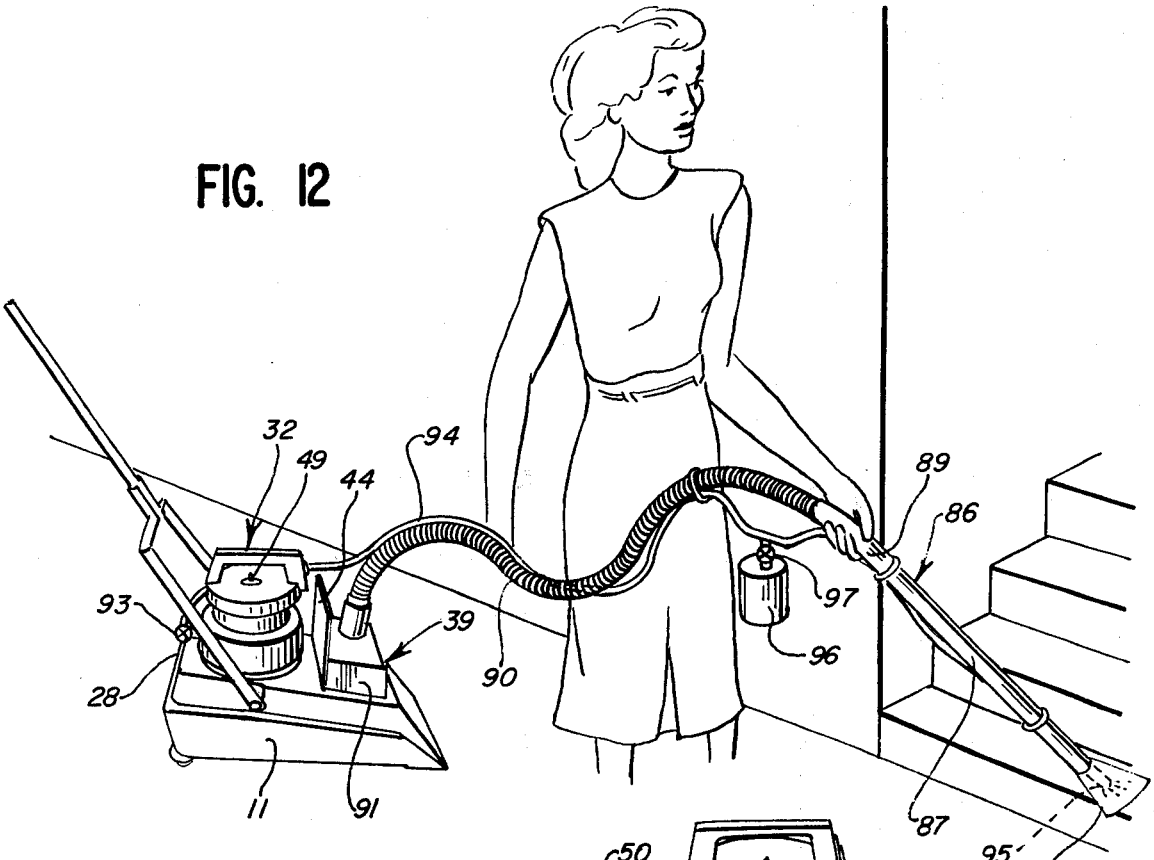
FIG. 14
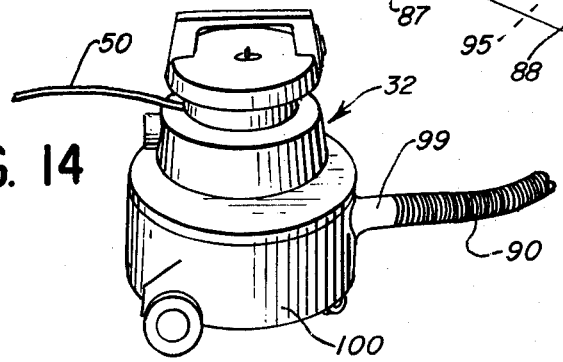
FIG. 13
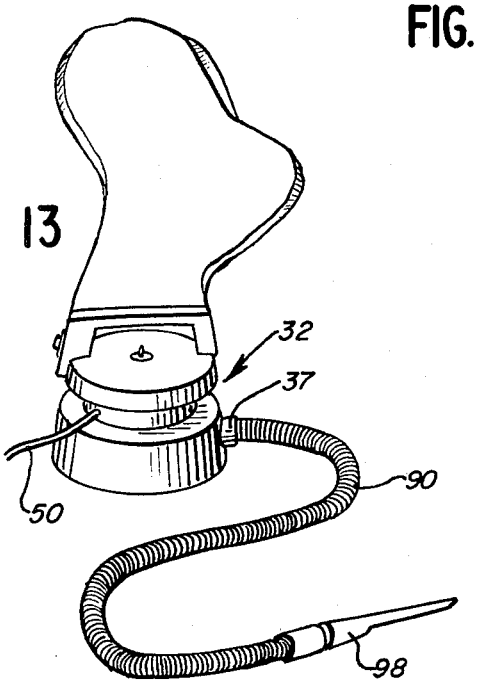
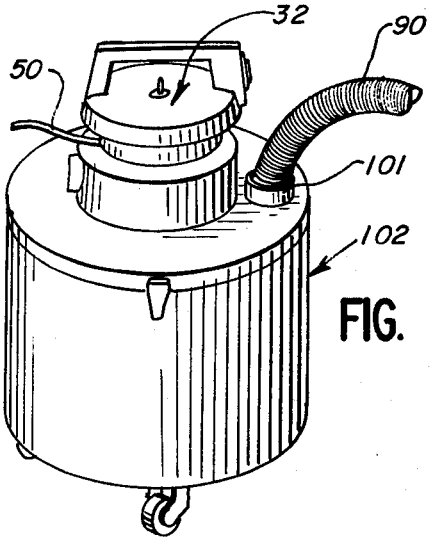
FIG. 15

WET CARPET CLEANING APPARATUS

BACKGROUND OF THE INVENTION

1. Field of the Invention

This invention relates to carpet cleaning apparatuses and in particular to wet carpet cleaning apparatuses.

2. Description of the Prior Art

Don C. Krammes discloses in U.S. Letters Pat. No. 2,986,764, a combined scrubbing and water pickup, or drying, appliance wherein water is dispensed onto the surface to be cleaned, scrubbing is effected without applying further water to the surface, and a suction is applied to a nozzle portion of the apparatus to dry the surface and remove the dirty water therefrom. The cleaning liquid may comprise soapy water which can be delivered either prior to the scrubbing operation or during the scrubbing operation as desired. The apparatus carries the water tank as a cleaning liquid supply means and carries a collapsible bag for collecting the dirty water.

Paul E. Phillips et al, in U.S. Pat. No. 3,940,826, disclose a portable surface cleaner wherein the cleaning liquid is delivered through a suitable hose connected to a faucet which acts as a remote source of clean water. The dirt-laden liquid is removed by a pump and delivered through a hose to a remote drain, as desired.

Another example of floor cleaning apparatus of this general construction is illustrated in U.S. Letters Pat. No. 3,974,541 of Donahue B. Silvis et al. As disclosed therein, a portable floor cleaning apparatus is provided wherein the cleaning liquid is supplied from a tap or faucet and the dirty water is pumped to a suitable waste water depository, such as a sanitary bowl, sink or floor drain.

Still another surface cleaning apparatus of this type is illustrated in U.S. Pat. No. 4,114,229 of Terry H. Jones et al. As disclosed therein, the apparatus is connected to a water supply, preferably of hot water, such as a sink faucet or the like, and a discharge tube which is connected to a drain. As shown, the suction blower provided for removing the dirt-laden liquid from the surface being cleaned is mounted within the housing of the nozzle.

Matthew Hurwitz discloses, in U.S. Pat. No. 4,123,818, an accessory for a conventional tank-type wet pickup vacuum cleaner including a reservoir filled with cleaning solution and a spray nozzle mounted to the vacuum pickup nozzle. A hand-controlled valve permits the operator to dispense cleaning solution to effect a cleaning of the carpet and permits interruption of the flow of cleaning solution while vacuuming the wetted carpet to remove the dirt-laden liquid therefrom.

SUMMARY OF THE INVENTION

The present invention comprehends an improved wet carpet cleaning apparatus which is extremely simple and economical of construction while yet providing a number of highly desirable features and advantages over those of the prior art carpet cleaning structures.

More specifically, the invention comprehends providing such a wet carpet cleaning apparatus wherein means for applying suction to the nozzle suction inlet is mounted directly on the nozzle adjacent a cleaning position to which cleaning liquid is delivered in effecting a scrubbing operation.

The invention further comprehends the provision of a wet carpet cleaning apparatus having means defining a front portion of the nozzle provided with a low height, a suction inlet of the nozzle being disposed in the low height portion of the nozzle which permits cleaning of carpet edge portions disposed in toe spaces and the like defined by wall means spaced a short distance above the carpet edge portions.

The invention still further comprehends such a wet carpet cleaning apparatus wherein a relatively heavy weight is provided on the nozzle adjacent the scrubbing portion of the nozzle for urging the scrubbing portion against the carpet. In the illustrated embodiment, the heavy weight comprises a portion of the suction-applying means.

The invention further comprehends the provision of such a wet carpet cleaning apparatus having means adjacent the suction inlet of the nozzle for separating large particles and fibrous material from the dirt-laden cleaning liquid with means permitting a user of the cleaning apparatus at all times to determine the amount of material collected in the separating means.

The separating means is arranged to provide ready access thereto for facilitated disposal of the separated material.

The invention yet further comprehends such a wet carpet cleaning apparatus having a supply duct means, a jet pump defining a discharge outlet, and means for selectively delivering the pressurized water from the supply duct means to the floor cleaning position for cleaning the carpet.

The invention further comprehends a wet carpet cleaning apparatus further having means for selectively cleaning elevated surfaces, including a suction hose connected to the means for applying suction on the nozzle, the suction hose having a distal end provided with a suction nozzle, and means for selectively delivering cleaning liquid to adjacent the suction nozzle. Thus, the apparatus is adapted to be selectively used to clean a floor surface or an elevated surface as desired.

The invention still further comprehends the provision of such a wet carpet cleaning apparatus having brush means removably mounted to the nozzle at the cleaning position for scrubbing hard floor surfaces when desired.

The apparatus may further include a squeegee element removably mounted to the nozzle adjacent the suction inlet for squeegeeing cleaning liquid from such hard floor surfaces when desired.

The apparatus may be provided with handle means connected to the nozzle for selectively positioning the brush means or squeegee means in operative position by suitable disposition of the nozzle.

Still further, the invention comprehends the provision of a wet carpet cleaning apparatus having fluid-operated means for discharging the removed dirt-laden liquid, such as to drain. In the illustrated embodiment, the fluid-operated means comprises a jet pump.

The wet carpet cleaning apparatus of the present invention is extremely simple and economical of construction while yet providing the improved features discussed above.

BRIEF DESCRIPTION OF THE DRAWING

Other features and advantages of the invention will be apparent from the following description taken in connection with the accompanying drawing wherein:

FIG. 1 is a perspective view of a wet carpet cleaning apparatus embodying the invention, with the suction-applying means and fibrous material screening means being shown in removed association relative to the nozzle thereof;

FIG. 1*a* is a fragmentary view similar to that of FIG. 1 showing the assembled relationship of the elements of the apparatus;

FIG. 2 is a perspective bottom view of the apparatus;

FIGS 6*a*–6*d* are diametric sections of valve means provided for selectively delivering clear water or a selected concentration of detergent to the cleaning liquid water as desired;

FIG. 7*a* is a fragmentary diametric section illustrating the manually operable control for controlling the valve means of FIGS. 6*a*–6*d;*

FIG. 7*b* is a view similar to that of FIG 7*a* but with the manual control arranged so as to provide a maximum amount of detergent to the cleaning liquid;

FIG. 8 is a fragmentary side elevation with a portion broken away illustrating the provision of an auxiliary brush for improved scrubbing of a hard floor surface to be cleaned with the apparatus;

FIG. 9 is a fragmentary side elevation with a portion broken away illustrating the use of a squeegee on the nozzle for squeegeeing liquid from the hard surface being cleaned;

FIG. 10 is a diametric section of a jet pump used in the apparatus for discharging the collected dirt-laden liquid to drain;

FIG. 11 is a side elevation of the apparatus as stored by hanging thereof from a wall hook;

FIG. 12 is a perspective view of a modified form of cleaning apparatus embodying the invention;

FIG. 13 is a perspective view of a leaf blower utilizing the suction means of the carpet cleaning apparatus;

FIG. 14 is a perspective view of a dry canister-type vacuum cleaner utilizing the suction means of the carpet cleaning apparatus; and FIG. 15 is a perspective view of a shop-type vacuum cleaner utilizing the suction means of the carpet cleaning apparatus.

DESCRIPTION OF THE PREFERRED EMBODIMENT

Figure 3:
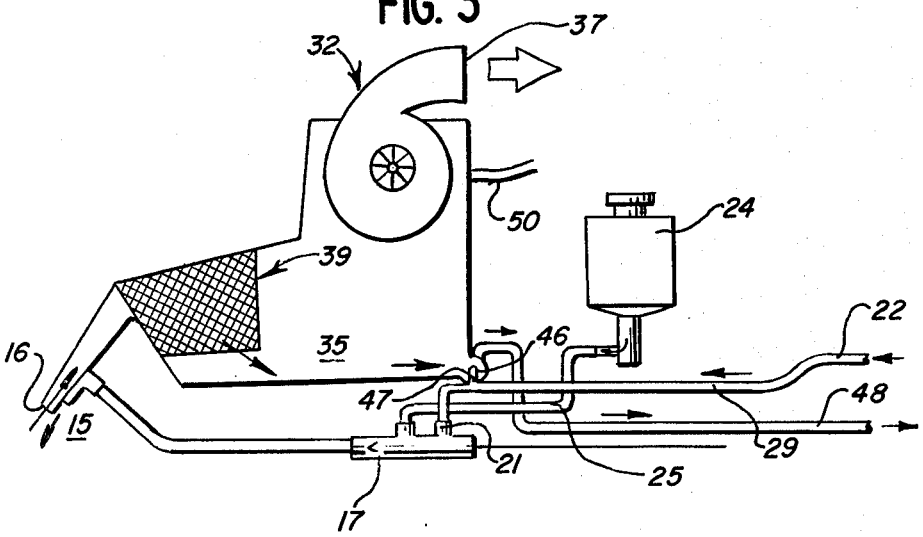
FIG. 3 is a schematic diagram illustrating the functioning of the apparatus.

In the exemplary embodiment of the invention as disclosed in the drawing, a wet carpet cleaning apparatus generally designated 10 is shown to comprise a nozzle 11 having a handle 12 connected thereto. The nozzle is provided with pair of rear wheels 13 permitting the nozzle to be rolled along a subjacent floor surface to suitable manipulation of the handle.

As shown in FIG. 1, the nozzle 11 defines a wet carpet cleaner housing including a downwardly forwardly inclined front end 14 adapted to be received under wall means and the like spaced a short distance above the floor surface, such as in toe spaces and the like. As seen in FIG. 2, the underside of front portion 14 of nozzle or housing 11 defines a downwardly opening cleaning space 15 and a downwardly opening suction nozzle 16 forwardly of the cleaning space.

On the underside of the rear portion of the nozzle, the nozzle carries a detergent valve structure 17 including a movable valve member which is connected through a control cable 18 to a manually operable actuator 19 (FIGS. 1, 7*a*, 7*b*) carried on a manually grasped end portion of the handle 12. As shown, the control cable 18 extends upwardly through the hollow handle 12 to the manipulating member 19 for selectively arranging the movable valve member, as will be brought out in greater detail herefollowing. Briefly, however, the valve 17 structure defines a housing including a water inlet 21 connected to a water supply duct 22, a detergent inlet 23 connected to a detergent supply 24 by a conduit 25, and an outlet 26 connected to a spray head 27 for discharging cleaning liquid downwardly into cleaning space 15, as shown in FIG. 2.

The water supply conduit 22 is adapted to be connected at its distal end to a suitable source of pressurized water such as a household water system faucet 22*a*, which may comprise a source of hot and cold water as desired. A branch conduit 28 is connected to the water supply conduit 22 at the rear of the nozzle. Downstream of the branch conduit, the conduit 22 is connected to a delivery conduit portion 29, conduit portion 29 being connected to the valve inlet 21.

Figures 5, 5A:
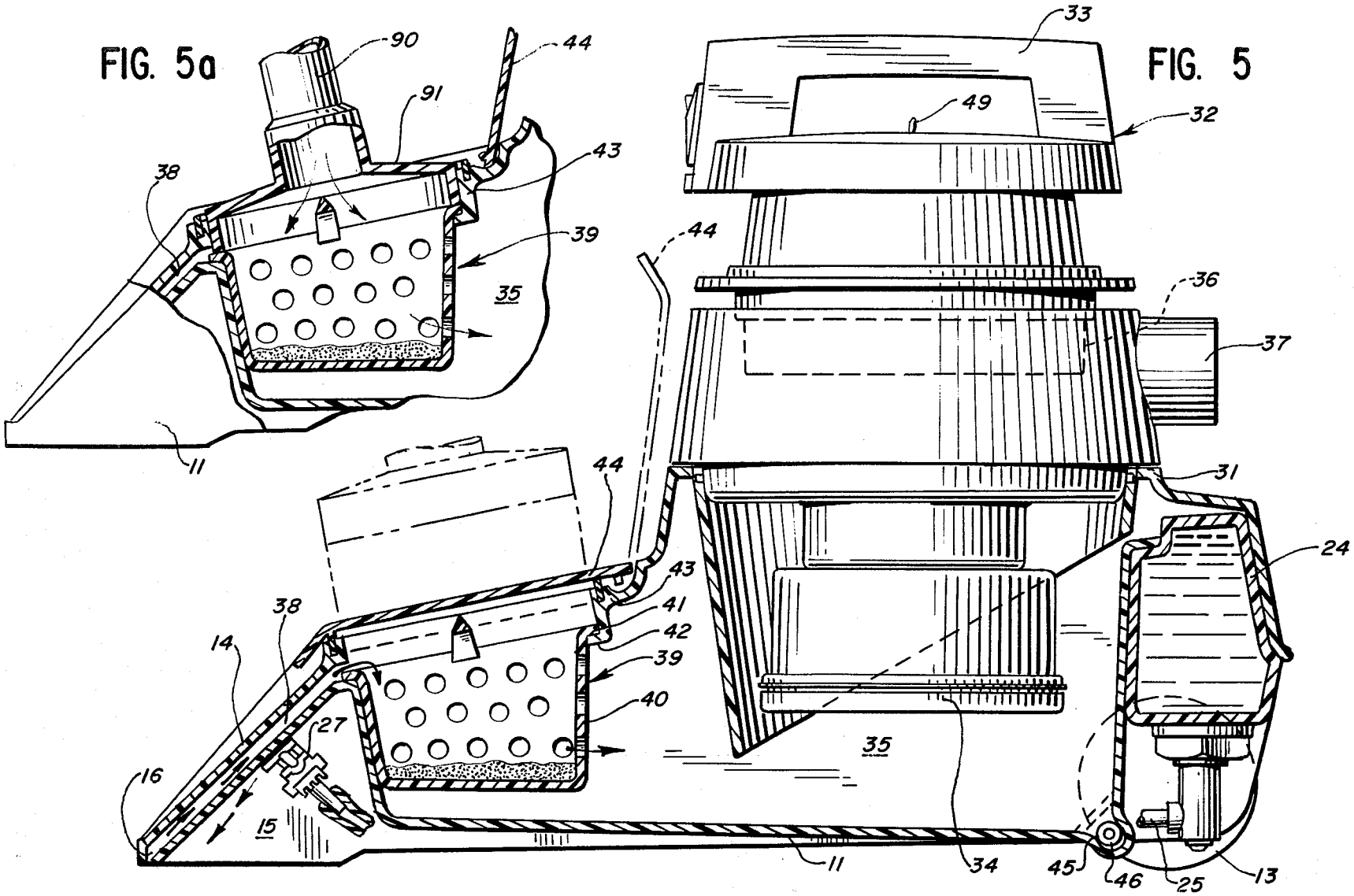
FIG. 5 is a vertical section taken substantially along the line 5—5 of FIG. 4.
FIG. 5*a* is a fragmentary vertical section illustrating the connection to the nozzle of an auxiliary cleaning apparatus suction connector.

As shown in FIG. 1, the nozzle or housing 11 further defines an upper collar 31 adapted to receive a suction fan unit generally designated 32. The suction fan unit is provided with an upper handle 33 for use in removably installing the suction fan unit in the collar 31 so as to dispose a lower inlet portion 34 of the unit in a collecting space 35 within the bottom of the nozzle, as seen in FIG. 5. The suction fan unit includes an electric motor 36 for operating the same so as to suck in air from collecting space 35 and discharge it outwardly through a discharge outlet 37. The motor 36 may advantageously be of the by-pass type in which there are separate air passages for moisture laden air being pumped by the suction fan unit and for the air stream which is used to cool the motor.

As further seen in FIG. 5, front portion 14 of the nozzle defines a suction passage 38 leading from suction inlet 16 to the collecting space 35 within the nozzle. At the inner end of the suction passage, the collecting space is provided with a separating unit generally designated 39 for separating fibrous material, such as hair and the like, and large particles from the fluid being sucked through suction inlet 16 into the collecting space 35. As shown in FIG. 5, the separating unit includes a foraminous cup-shaped element 40 having an upper outturned flange 41 removably resting on an inturned flange 42 of a support collar 43 on the top wall of the nozzle forwardly of the suction unit collar 31. A transparent cover 44 is removably mounted on the support 43 to permit continual observation of the material collected in the cup element 40 so that the cup element may be removed and the collected material discharged therefrom when it reaches a preselected maximum amount in the cup-shaped element.

As further shown in FIG. 5, at the rear of the collecting space 35, the nozzle defines a downwardly extending well 45 in which is disposed a jet pump 46 shown in detail in FIG. 10. The jet pump 46 is connected at all times to the large supply duct 22 by a branch conduit 47 leading from supply conduit portion 29, as seen in FIG. 2. The jet pump acts to suck dirt-laden water from the rear of the collecting space 35 in well 45 and deliver it through a discharge conduit 48 to a suitable drain. Thus, at all times during operation of the carpet cleaning apparatus, the jet pump comprises a fluid-operated means for removing all collected liquid from the collecting space 35 effectively minimizing any collected quantity of liquid therein for facilitated movement of the nozzle over the floor surface being cleaned. As shown in FIG. 1, the suction fan unit 32 is provided with an electrical control switch 49 for continued operation of the suction fan unit during operation of the carpet cleaning apparatus. Electrical power for driving the suction fan unit motor 36 under the control of switch 49 is provided by a suitable electrical cord 50 connected to a suitable electrical power source (not shown).

As indicated briefly above, control of the cleaning liquid supply to the spray head 27 is effected by the user through manipulation of the actuator 19 in handle portion 20 illustrated in FIG. 1 to control the detergent valve structure 17. Referring to FIGS. *6a–6d,* and *7a* and *7b,* control cable 18 is moved longitudinally by actuating a control lever 53. The movement of lever 53 is limited by a cam 51 which is coaxially secured to a rotatable thumb piece 52 forming part of actuator 19. The control lever 53 has one end pivotally mounted to a pivot 54 in the handle portion 20. The control lever 53 is biased in a clockwise direction, as see in FIGS. *7a* and *7b,* by a suitable spring 55 having one end secured to a spring retainer 56 within the handle portion 20, and an opposite end bearing against the lever 53 extending outwardly through a suitable opening 57 in the handle portion 20. As shown in FIG. *6a,* a spring 58*a* disposed between the end wall (not shown) of valve housing 61 and movable valve element 58 tends to urge the movable valve element 58 to a closed position wherein the pressurized water entering the valve structure 17 through inlet 21 is retained between a pair of longitudinally spaced O-rings 59 and 60 on the movable valve element disposed at opposite sides of the inlet 21 in sealing engagement with the outer housing 61 of the valve.

When the user rotates the thumb piece 52 in a clockwise direction from the off position of FIG. *7a,* a cam follower portion 63 of the lever 53 is permitted to move radially inwardly toward the axis 64 of the cam and thumb piece in following the cam.

The user may urge the lever 53 in a counterclockwise direction about pivot 54 against spring 55 to pull on control cable 18 and spring 58*a* to the extent permitted by the selective positioning of cam 51. Thus, as seen in FIG. *6b,* when the control cable 18 is moved a small distance longitudinally outwardly relative to the valve housing 61, the movable valve element 58 is moved a short distance to the right, as seen in FIG. *6b,* so as to provide communication from water supply inlet 21 to an axial bore 65 within the movable valve element through an opening 66 therein. The detergent inlet 23 continues to be locked by a pair of O-rings 67 and 68 on opposite sides of the inlet. Thus, the supply water may flow from inlet 21 through opening 66 and axial passage 65 through a discharge end 69 of the movable valve member into the outlet 26 of the valve housing 61. Thus, with this setting of the valve, water only is delivered through the spray head 27 onto the subjacent floor surface to be cleaned. As pointed out above, at all times, water delivered from conduit 22 is caused to flow through the jet pump 46 and, thus, jet pump 46 is, at this time and at all other times, attempting to maintain the collection space 35 free of any collected liquid. Thus, any water delivered through the spray head 27 onto the floor surface and sucked up through the suction nozzle 16 is effectively immediately delivered to the discharge drain to maintain the collecting space free of any substantial amount of collected liquid.

When the thumb piece 52 is rotated further in a clockwise direction from the position of FIG. *7a,* cam follower 63 may move radially inwardly toward axis 64 and, thus, depression of the lever 53 at this time pulls further on the control cable 18 such as to the position shown in FIG. *6c* wherein the movable valve member 58 has moved further to the right so as to not only provide communication between the water supply inlet 21 and the outlet 26 through the movable valve member passage 65, but also provides communication from the detergent, or soap, inlet 23 and the outlet 26 around the discharge end 69 of the movable valve member, i.e. to the left of the O-ring 67 which has now moved to the right of the inlet passage 23. Thus, at this time, some detergent is being delivered into the wash water delivered from inlet 21 so as to provide a low detergent concentration cleaning liquid delivery to the surface being cleaned.

When the cam 51 is moved to its extreme position, as shown in FIG. *7b,* by suitable manipulation by the thumb piece 52, lever 53 may be moved fully counterclockwise into engagement with the handle portion 20 so as to provide maximum housing 61. Thus, as shown in FIG. *6d,* the movable valve movement of the control cable 18 outwardly from the valve member 58 has moved to its extreme righthand position wherein maximum communication is provided between the detergent inlet 23 and outlet 26 of the valve housing so as to provide a high detergent concentration in the cleaning liquid to the spray head 27 for maximum cleaning operation.

Release of the lever 53 by the operator permits the movable valve member 58 to urge the cable 18 back into the valve housing 61 with the spring 58*a* bearing against the end of movable valve member 58 and spring 55 urging the lever 53 back to the off position of FIG. *7a.* Subsequent depression of the lever 53 to bring the follower 63 against the cam 51 will be permitted to whatever extent rotation of the thumb piece 52 has been effected. Thus, in the absence of any repositioning of the thumb piece, successive release and depression of the lever 53 will provide successive deliveries of cleaning liquid to the spray head as determined by the specific setting of the thumb piece.

The arrangement of the cleaning apparatus, as discussed above, is adapted for facilitated cleaning of a carpet. Thus, the apparatus may be utilized in a simple manner as follows. After connecting the water supply conduit to a suitable water supply, such as the household water system faucet 22*a* providing hot or cold water or mixture thereof under suitable pressure at a desired temperature, and connecting the discharge conduit 48 to a suitable drain which may advantageously be in a sink which includes the faucet 22*a,* the water supply may be turned on so as to deliver water to the apparatus. With the control 19 set in the off position, water will flow from the water supply duct 22 to the drain through the jet pump immediately arranging the apparatus to discharge any liquid collected in the collecting space 35.

The operator may then position the nozzle at a forward righthand corner of the carpet space to be cleaned and operate control 19 suitably to deliver to the spray head 27 a desired cleaning liquid including a desired concentration of detergent. At the same time, the operator manipulates the handle 12 so as to move the nozzle on wheels 13 rearwardly so that very quickly after the detergent liquid is sprayed onto the carpet, suction nozzle 16 picks up a substantial portion of the liquid delivering it through the strainer 40 into the collecting space from which it is substantially immediately discharged to drain by the jet pump action discussed above. After a small area of the carpet is so cleaned with detergent, the operator may return the nozzle to the original start position and then repeat the operation with the cleaning liquid being delivered as clear water only, thereby rinsing the remaining detergent from the carpet and discharging it in a similar manner to drain. The suction action is effected by the suction unit 32 which may be maintained on during the entire cleaning and rinsing operation.

To provide a further drying of the carpet, the operator may again return the nozzle to the start position and move the nozzle over the rinsed carpet with the control 19 set in the off position so as to merely apply an air suction to the carpet for facilitating drying thereof.

Depending on the soiled condition of the carpet, suitable control of the amount of detergent applied thereto may be readily effected by setting of the thumb piece 52 as discussed above.

It is desirable to provide a fluid-operated jet pump so as to limit the electrical components of the apparatus solely to the removable vacuum suction unit 32. Thus, as shown in FIG. 10, the jet pump 46 includes a nozzle 70 and a diffuser 71. The nozzle defines a hose connection 72 for connection thereto of the hose 29, a fitting connection 73 for connection thereof to the valve inlet 21, and a tapered outlet portion 74 extending into the collecting space well 45. Suitable O-rings 75 may be provided for sealing the nozzle to the walls of nozzle 11 defining the well 45.

The diffuser defines a frustoconical inlet passage 76, and an outwardly widening outlet passage 77 communicating with the discharge conduit 48. As shown in FIG. 10, the diffuser is sealed to the wall of nozzle 11 by an O-ring 78.

The pressurized water passing from conduit 29 flows through the nozzle outlet 74 into the coaxial diffuser inlet 76 so as to suck collected liquid from the well 45 into the diffuser inlet by the pressure condition obtained as a result of the flow of the pressurized water successfully through the inlet 76 and widening outlet 77 of the diffuser. As indicated above, the jet pump 46 is preselected to have sufficient capacity to effectively maintain the collecting space 35 free of any substantial amount of liquid during operation of the apparatus.

The cleaning apparatus is also adapted for cleaning relatively hard floor surfaces as well as carpeted surfaces. Thus, as shown in FIGS. 8 and 9, the nozzle bottom wall 79 may be provided immediately rearwardly of the cleaning space 15 with a brush 80 which may be utilized to scrub the hard surface with the deliverd detergent cleaning liquid. The bristles 81 of the brush may be relatively stiff so as to tip the nozzle 11 slightly forwardly upwardly on the rear wheels in effecting the scrubbing operation.

A squeegee 82 may be mounted on the front end of the nozzle portion 14 forwardly of the suction inlet 16 so as to squeegee the liquid from the floor surface F into the suction inlet for facilitated removal of the dirt-laden liquid by the jet pump, as discussed above. In effecting the engagement of squeegee 82 with the floor surface F, the user lifts the handle 12 to raise the rear wheels off the surface F about the bristles 81 of the brush 80 in the manner illustrated in FIG. 9.

As illustrated in FIGS. 1 and 11, the handle portion 20 may be provided with a recess 83 for receiving a hook 84 carried on a wall 85 for hanging the apparatus from the hook in a stored disposition, as shown in FIG. 11.

Referring now to FIG. 12, a modification of the apparatus is illustrated to comprise a stair or upholstery cleaning means generally designated 86. As shown, a tubular wand 87 may be provided at one end with a suction nozzle 88 and at the other end with a handle portion 89 connected through a flexible hose 90 to a connector 91 removably connected to the separating unit 39 in nozzle 11, as illustrated in greater detail in FIG. 5*a*. As shown therein, the connector is received in the support collar 43 suitably to close off the suction passage 38 and permit suction through hose 90 only.

As shown in FIG. 2, branch conduit 28 in connected to the water supply conduit 22 by a T-connector 92. As shown in FIG. 12, the branch conduit 28 is provided with a manually operable valve 93 controlling delivery of cleaning liquid from branch conduit 28 through a delivery conduit 94 mounted to the hose 90 and terminating under the suction head 88 in a spray nozzle 95.

A detergent supply container 96 is connected to conduit 94 through a selector valve 97 for controlling delivery of either clear water from supply conduit 28 or water with detergent added thereto from the supply 96. Valve 97 includes a conventional eductor for aspirating into the cleaning liquid controlled amounts of detergent from container 96 in a conventional manner.

Thus, as shown in FIG. 12, when it is desired to clean stairs, furniture, etc., with the apparatus 10, the auxiliary means 86 is connected to the suction separating unit 39 of nozzle 11. Conduit 94 is connected to valve 93 and valve 93 is opened to permit delivery of pressurized water from the supply conduit 22 to the control valve 97. By suitable manipulation of control valve 97, the user may apply detergent cleaning liquid or clear rinse water, as desired. The user simply effects the spraying of the cleaning liquid on the surface to be cleaned through the nozzle 95 while moving the wand 87 rearwardly to quickly remove excess cleaning liquid from the surface being cleaned by the suction removal thereof into the collecting space 35 in a manner similar to the suction removal of cleaning liquid from the floor surface through suction nozzle 38.

In effecting a final drying of the surface being cleaned either with suction nozzle 38 or suction head 88, the cleaning liquid delivery may be stopped and the surface gone over with the suction head alone, as desired.

Thus, the attachment 86 functions in a similar manner as the main suction unit providing an improved facilitated wet cleaning operation.

As indicated briefly above, the suction unit 32 comprises a separate removable power module or motor-operated fan or suction unit having its own control switch 49 and power supply cord 50. Thus, in one embodiment, the hose 90 may be provided with a conventional blower nozzle 98 and connected to the air outlet 37 of the unit 32 so as to define a leaf blower or the like provided with a shoulder carrying strap 98*a*, as illustrated in FIG. 13. Alternatively, the hose 90 may be connected to the suction inlet 99 of the canister 100 of a conventional canister-type vacuum cleaner, with the suction unit 32 being removably mounted thereto, as illustrated in FIG. 14.

Still further, the hose 90 may be connected to the suction inlet 101 of a wet or dry pick-up shop vacuum cleaner generally designated 102, with the suction unit 32 being removably mounted thereto.

In the illustrated embodiment, the removable connection of the suction fan unit 32 may be effected by means of a tang 103 on portion 34 of the unit and movably received in a L-shaped groove 104 provided in the collar portion 43, as illustrated in FIG. 1. As will be obvious to those skilled in the art, any suitable releasable locking means may be employed within the scope of the invention.

The suction fan unit 32 (FIG. 1) preferably is a high power by-pass type fan unit as described above capable of sucking a body of liquid through the suction inlet of the apparatus.

The supply duct for providing cleaning liquid including clean water to the nozzle, and the discharge duct for delivering dirt-laden liquid to a drain, advantageously have lengths of at least approximately 50 feet to cover a conveniently large area.

Figure 4:
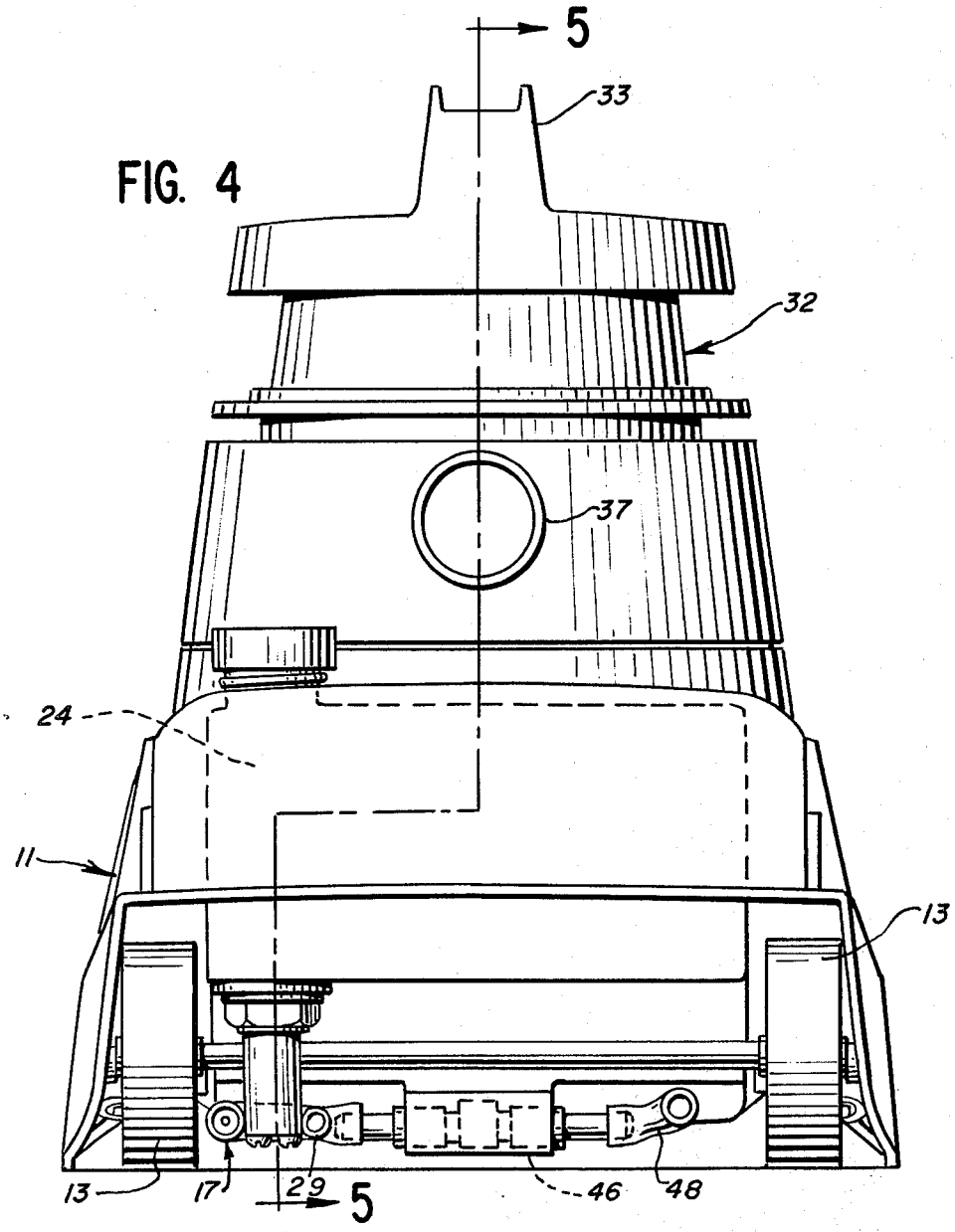
FIG. 4 is a rear elevation of the apparatus.

The jet pump 46 (FIGS. 4, 5 and 10) is preferably a relatively powerful pump unit capable of pumping a substantial quantity of liquid per unit time, and in the illustrated embodiment, comprises a jet pump capable of pumping 15 gallons per hour so as to effectively maintain the collecting space free of any substantial quantity of collected liquid. The jet pump 46 of the present invention can be operated dry without concern for damage to the pump, in contrast to prior art wet carpet cleaners which employ pumps to pump used cleaning water from a recovery chamber to a remote source of discharge such as a drain. In such prior art carpet cleaners when the chamber which receives the used cleaning liquid picked up from the surface being cleaned is pumped empty, the pump is dry operated causing severe wear and damage to the internal elements of the pump and to the pump motor due to overheating. This problem cannot occur when using the jet pump of the present invention.

As will be obvious to those skilled in the art, the system may be provided with suitable check valves or siphon breaks so as to prevent dirty water from entering the fresh water supply system. The system may be provided with a suitable liquid flow control device and arranged to be operated at a pressure of approximately 15 to 20 lbs. per square inch pressurized liquid supply. Adjustable control of the detergent supply permits the user to readily select light, medium and heavy washing cycles as well as clear rinse cycles in applying cleaning liquid to a carpet to be cleaned.

As the suction fan unit is readily removable, separate cleaning of the wet carpet cleaning unit including the nozzle may be readily effected by submersion in cleaning liquid without concern for electric shock hazard.

The apparatus is extremely simple and economical of construction while yet providing great flexibility in use for application of cleaning liquid to a carpet to be cleaned and improved cleaning operation.

The foregoing disclosure of specific embodiments is illustrative of the broad inventive concepts comprehended by the invention.

The embodiments of the invention in which an exclusive property or privilege is claimed are defined as follows:

1. In a wet carpet cleaning apparatus having a nozzle provided with a suction inlet, means for selectively providing cleaning liquid to a cleaning position adjacent the suction inlet for cleaning a carpet, means defining an air suction chamber connected to said nozzle, and selectively operable suction means for drawing suction air through said suction inlet to said suction chamber to remove dirt-laden cleaning liquid from the carpet, said suction means discharging the suction air from said suction chamber, the improvement comprising:

supply duct means for connecting the means for providing cleaning liquid to said cleaning position to a source of pressurized supply water;

a first jet pump communicating with said suction chamber and defining a discharge outlet;

means for causing delivery of the pressurized supply water (a) selectively to said means for providing cleaning liquid to said cleaning position for cleaning the carpet, and (b) at all times to said first jet pump;

means including a second jet pump for selectively (a) aspirating detergent into the pressurized supply water being delivered to define a detergent cleaning liquid for cleaning the carpet, or (b) permitting the pressurized supply water to be delivered free of detergent to define a clear cleaning liquid such as for rinsing the carpet subsequent to subjection thereof to the detergent-added water, said dirt-laden detergent cleaning liquid and the rinse liquid being successively drawn from said suction chamber by said first jet pump to be pumped substantially immediately to said discharge outlet by the pressurized water being delivered constantly to said first jet pump; and discharge duct means for delivering the discharged liquid from the discharge outlet of said first jet pump.

2. The wet carpet cleaning apparatus of claim 1 wherein said duct means has a length of approximately 50 feet.

3. The wet carpet cleaning apparatus of claim 1 wherein said means for applying suction comprises an electric suction motor defining the sole electrically operated means of the apparatus.

4. The wet carpet cleaning apparatus of claim 1 wherein said means for applying suction comprises an electric suction motor removably mounted to said nozzle and defining the sole electrically operated means of the apparatus permitting the nozzle to be cleaned by submersion upon removal of said motor therefrom.

5. The wet carpet cleaning apparatus of claim 1 wherein said first jet pump comprises means defining a pump chamber having an inlet for receiving liquid from said suction chamber, a diffuser leading from said pump chamber, and an injection nozzle for directing a stream of the liquid through the dirt-laden liquid in said chamber into said diffuser for sucking the dirt-laden liquid from the chamber by jet pump action for delivery therefrom to drain.

6. The wet carpet cleaning apparatus of claim 1 wherein said first jet pump comprises means for discharging cleaning fluid at a rate greater than the maximum rate of delivery of the to said suction chamber by said suction-applying means.

7. The wet carpet cleaning apparatus of claim 1 further including means for removing the cleaning liquid from the carpet by said suction-drawing means without concurrent delivery of cleaning liquid to said cleaning position.

* * * * *

UNITED STATES PATENT AND TRADEMARK OFFICE

CERTIFICATE OF CORRECTION

PATENT NO. : 4,458,377

DATED : July 10, 1984

INVENTOR(S) : Edwin H. Frohbieter

It is certified that error appears in the above-identified patent and that said Letters Patent is hereby corrected as shown below:

Claim 1, column 10, line 3, after "operable" cancel "suction" (first occurrence); and after "for" insert --applying suction for--; and in line 6, after "suction" (first occurrence), insert --applying--.

Claim 6, column 10, line 60, after "cleaning" cancel "fluid" and substitute therefor --liquid--; and in line 61, after "the" insert --liquid--.

Signed and Sealed this

*Ninth* Day of *July 1985*

[SEAL]

*Attest:*

DONALD J. QUIGG

*Attesting Officer* *Acting Commissioner of Patents and Trademarks*